United States Patent [19]

Alnot et al.

[11] Patent Number: 4,640,718

[45] Date of Patent: Feb. 3, 1987

[54] PROCESS FOR ACCELERATING PD/SN SEEDS FOR ELECTROLESS COPPER PLATING

[75] Inventors: Patrick R. Alnot, Toul, France; Daniel J. Auerbach, San Jose, Calif.; Christopher R. Brundle, San Jose, Calif.; Dolores C. Miller, San Jose, Calif.

[73] Assignee: International Business Machines Corporation, Armonk, N.Y.

[21] Appl. No.: 792,425

[22] Filed: Oct. 29, 1985

[51] Int. Cl.[4] ..... C23C 16/06

[52] U.S. Cl. ..... 134/2; 106/1.11; 427/304; 427/305; 134/26; 134/29

[58] Field of Search ..... 106/1.11, 1.25, 1.26; 134/25.1, 25.4, 26, 29, 2; 427/304, 305

[56] References Cited

U.S. PATENT DOCUMENTS

| | | | |
|---|---|---|---|
| 3,011,920 | 12/1961 | Shipley, Jr. | 106/1.11 |
| 3,798,050 | 3/1974 | Franz et al. | 106/1.11 |
| 4,085,066 | 4/1978 | Gulla | 427/304 |
| 4,187,198 | 2/1980 | Zeblisky | 106/1.11 |
| 4,201,825 | 5/1980 | Ebneth | 427/304 |
| 4,600,699 | 7/1986 | Courduvalis | 106/1.11 |

FOREIGN PATENT DOCUMENTS

| | | | |
|---|---|---|---|
| 0155602 | 1/1984 | Japan | 427/304 |

*Primary Examiner*—Asok Pal

*Attorney, Agent, or Firm*—Joseph G. Walsh

[57] ABSTRACT

Pd/Sn seeds for use in electroless copper plating are accelerated by treating them with an alkali metal hydroxide at a pH of about 11.3 and at a temperature above 50° C.

5 Claims, No Drawings

PROCESS FOR ACCELERATING PD/SN SEEDS FOR ELECTROLESS COPPER PLATING

DESCRIPTION

1. Technical Field

The present invention is concerned with a process for accelerating Pd/Sn seeds which are to be used for electroless copper plating.

2. Background Art

The use of Pd/Sn seeds for electroless copper plating is well known in the art. The preparation of such seeds is shown, for example, in U.S. Pat. No. 3,011,920. The patent describes a process to produce seeds which are colloidal particles protected by a coating containing a large amount of tin. The patent describes methods for accelerating such seeds by treatment with a whole range of reagents, including acids, sodium carbonate, sodium pyrophosphate, or sodium hydroxide at a concentration of 5% (see col. 5, line 39). The suggested treatment with 5% sodium hydroxide makes no mention at all of temperature.

In currently used commercial production, acceleration of the Pd/Sn seeds is often accomplished by treatment with hydrochloric acid.

DISCLOSURE OF THE INVENTION

According to the present invention, Pd/Sn seeds for use in electroless copper plating are accelerated by a process comprising treating said seeds with an aqueous solution of an alkali metal hydroxide at a pH of about 11.3 and at a temperature of above 50° C. Such a treatment selectively removes tin from the surfaces of the seeds while leaving the palladium. This is in sharp contrast to the results obtained using 5% sodium hydroxide as taught by U.S. Pat. No. 3,011,920. When the process of that patent is used, tin still remains a major component of the surface of the seeds. The presence of tin on the surface is very undesirable, because it serves to decrease the activity of the seed, and because it also serves as a source of tin to contaminate the plating bath subsequently used during the electroless deposition of copper. It should be noted that acceleration treatment with hydrochloric acid, as is most commonly done commercially at present, likewise results in seeds still having a large amount of tin on the surface.

Pd/Sn seeds typically have a surface having a Pd/Sn ratio of approximately 1 to 5. After acceleration with hydrochloric acid, as is currently used commercially, the Pd/Sn surface ratio is approximately 1 to 2, i.e., Sn is still the major component and the "acceleration" is at best only partially effective. By the process of the present invention, however, there are obtained treated seeds having a Pd/Sn ratio of 5 to 1.

Electroless copper plating is a process of very great importance in, for example, the manufacture of circuit boards. Typically, circuit boards are made of resin, i.e., an epoxy resin. The process of the present invention is particularly advantageous when used for the treatment of seeds on such a substrate.

It must be emphasized that the alkali metal hydroxide solutions used in the present invention have a pH about 11.3, i.e., they are quite weakly basic. Sodium hydroxide is the preferred alkali metal hydroxide and it is present at a concentration of approximately 0.005%, i.e., a concentration only one part in a thousandth of that shown in U.S. Pat. No. 3,011,920.

The treatment of seeds according to the present invention must be at an elevated temperature. This is in sharp contrast to U.S. Pat. No. 3,011,920 which does not refer to any temperature for the treatment. In the process of the present invention, it is essential that the treatment temperature by above 50° C. The preferred temperature is about 73° C.

We claim:

1. A process for accelerating Pd/Sn seeds to be used for electroless copper plating, said process comprising treating said seeds with an aqueous solution of alkali metal hydroxide at a pH of about 11.3 and at a temperature of above 50° C., thereby selectively removing Sn from the surface of the seeds and leaving the Pd.

2. A process as claimed in claim 1, wherein the aqueous metal hydroxide is sodium hydroxide.

3. A process as claimed in claim 1, wherein the sodium hydroxide is at a concentration of 0.005%.

4. A process as claimed in claim 1, wherein the temperature is 73° C.

5. A process as claimed in claim 1, wherein the seeds are on an epoxy resin substrate.

* * * * *